US005221058A

United States Patent [19]

Fillis

[11] Patent Number: 5,221,058

[45] Date of Patent: Jun. 22, 1993

[54] REGISTRATION CONTROL FOR CONTINUOUSLY MOVING LAMINATED PACKAGE APPARATUS

[75] Inventor: Tom Fillis, Williamstown, N.J.

[73] Assignee: Packaging Coordinators, Inc., Philadelphia, Pa.

[21] Appl. No.: 739,339

[22] Filed: Aug. 1, 1991

[51] Int. Cl.[5] ..... B65H 23/032; B65H 23/08

[52] U.S. Cl. ..... 242/57.1; 242/75.44; 226/29

[58] Field of Search ..... 242/57.1, 75.43, 75.44, 242/58.1; 226/2, 28-31, 15-23, 33

[56] References Cited

U.S. PATENT DOCUMENTS

| | | | |
|---|---|---|---|
| 2,375,451 | 5/1945 | Waters | 226/2 |
| 3,159,170 | 12/1964 | Callan | 226/15 X |
| 3,589,095 | 6/1971 | James et al. | 226/29 X |
| 4,129,238 | 12/1978 | Herd | 242/75.43 X |
| 4,485,982 | 12/1984 | St. John et al. | 242/57.1 |
| 4,500,045 | 2/1985 | Whitaker et al. | 242/57.1 |
| 4,839,674 | 6/1989 | Hanagata et al. | 242/57.1 |

OTHER PUBLICATIONS

Höfliger-Karg pp. 3-10, 12-15.

IMA C60, 2p text, 5p photos and drawings, 1p schematic wiring diag., dated Nov. 13, 1986.

Allen-Bradley TCAT, SLC programmable controller, 2p photos.

*Primary Examiner*—John M. Jillions

*Attorney, Agent, or Firm*—Frank Benasutti

[57] ABSTRACT

An apparatus and method is disclosed for joining continuously moving materials which must be in registry by monitoring and comparing signals and making adjustments in the feed of the materials. The registry means includes a data cam in the form of a star wheel, with lobes and valleys corresponding to areas on a scrolled cylinder engaging discreet segments of one of the materials.

10 Claims, 8 Drawing Sheets

REGISTRATION CONTROL FOR CONTINUOUSLY MOVING LAMINATED PACKAGE APPARATUS

BACKGROUND OF THE INVENTION

1. Field of the Invention

This invention relates to laminated packaging and more particularly to continuously moving rolls of printed material and pre-formed packing material, the relative movement of which must be tightly controlled so as to be in registration with one another in the finished package.

2. Description of the Prior Art

Packaging of the type known as "bubble" or "blister" often comprises a foil or paper printed portion which must be held in registry with a pre-formed transparent plastic portion. This is particularly important in those packages where the bubble portion in the pre-formed transparent plastic which contains the product must line up with the decorative material printed on the foil or paper, such as packaging for pharmaceutical samples.

In laminating such a product, registration is a problem because the materials cannot normally be accurately controlled in terms of their stretching during processing. Various attempts at doing this have been tried including the following. A machine produced by Bosch which is used on "soft" foil without paper backing, relies on a cam type ram to create intermittant stretching. In accordance with this machine as shown schematically in prior art FIG. 1, the material being processed passes between the jaws 100,102 of the ram 104. The ram has two cylindrical bars 106,108 spaced apart on one head with the axis of the cylinders being transverse to the direction of travel of the material 110. On the other head there is a single cylindrical bar 112 with its axis transverse to the direction of movement of the material. They are positioned as shown so that the two bars bracket the single bar. When the ram travels toward the material in the direction of the arrow shown in the figure, it can cause the material to be stretched by adjusting the amount of force against the faces of the material as it passes between the three rollers in contact with it. If the ram hits with great force, it may penetrate further into the material against the clamp resistance of the pads which grip the material intermittently, thereby stretching it even more, such a device would normally tear paper.

In another machine produced by an Italian company, the continuously moving material has a drag placed upon it by a moveable vacuum roller; as shown schematically in prior art FIG. 2. In this device material 200 proceeds from a main feed roll 202 around several vacuum rolls 204,206 to a seal roll 208. Between the main feed roll and the first vacuum roll there is an eye 210 which may sense a printed dot on the material. All of these rolls normally run at the same speed. If the eye senses a change is necessary, then the first vacuum roll 204 is slowed by one percent by a change of gears activated by the eye. Thus this design, with fixed gear ratios, limits control within fixed parameters.

Other prior art machines do not run continuously, but rather must stop and adjust the length and position of the materials with respect to one another. In such machines, known as "flat seal" machines, the material is grabbed and pinched. If the electric eye sensors indicate that the foil and plastic are too far out of alignment, then the machine adjusts with a fixed stop adjustment (like a vernier) which adjusts the length by not allowing as much movement. However, to my knowledge this was never done on a rotary machine for continuously moving materials.

Other problems in the prior art relate to the conditions under which these machines operate, such as the heat and vibration, which tend to throw off the printing alignment and interfere with normal printing operations.

SUMMARY OF THE INVENTION

The present invention solves the problems of the prior art by printing a mark on a material; and then sighting that mark with a sensor eye as the material continuously moves toward the lamination station. The sensor sends a signal to a controller. Another sensor monitors the continuously moving plastic pre-formed material and also sends a signal to the controller. An electrically operated magnetic brake applies a force on the main feed roll of the marked material to stretch the marked material. Typically the pre-printed marked material is purposely printed shorter than it has to be and then stretched into registry with the plastic material. When the two signals arrive at the controller at the same time, the controller increases the amount of force being applied by the brake to a pre-printed marked material, thus causing it to stretch even more. This occurs when the marked material has advanced to the point where it is no longer in proper registry with the plastic material. In accordance with my invention this allows for continuously laminating pre-printed material in more precise registration with the pre-formed plastic materials forming the package, by drawing the pre-printed material back into registry.

DESCRIPTION OF THE PREFERRED EMBODIMENT

Figure 3:
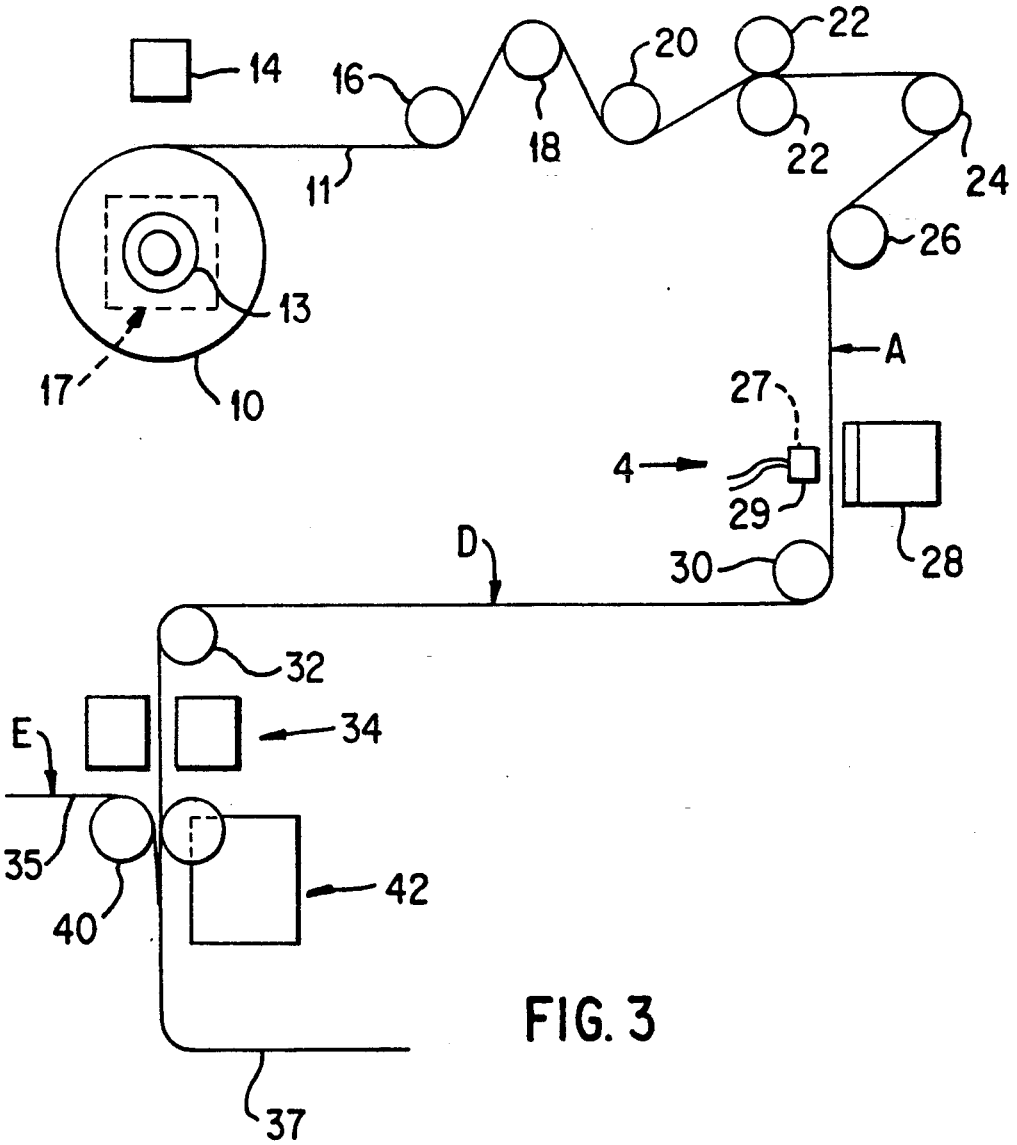
FIG. 3 is a schematic front elevational view of a portion of the apparatus in accordance with my invention.

The preferred embodiment of this invention is shown schematically in FIG. 3 from which it will observed that the preprinted material in the form of a coil of foil or paper 10 is fed into the machine from a first feed roll 13. This coil is monitored by a sonar sensor 14. The sonar device overlooking the first feed roll automatically tracks the diameter of the roll. As the roll gets smaller, the sensor senses that the distance is changing, and feeds this information to a controller means (not shown, but of known characteristics) which is part of the tension control means, thereupon feeds less voltage to the magnetic particle brake 17 fixedly mounted in the machine. This brake is connected to the feed roll, most preferably by a toothed belt drive, and exerts a drag on the feed roll. This brake responds by easing up and therefore decreases the drag and thus the tension in the foil; whereupon the foil moves forward faster in the machinery.

After passing over guide rolls, 16, 18, and 20 the pre-printed material passes through a pair of printing rollers 22 which can print information, such as the lot numbers or expiration dates on the side A of the material. However, in accordance with my invention it will be understood that a registration mark or "dot" is already pre-printed on the side A of the pre-printed material. Thus this additional printing, while useful in connection with this invention, is not necessary.

The material then passes over two additional guide rolls 24 and 26 which can be manually adjusted to change the downstream registration of the material with respect to the plastic pre-formed material 35. This can be done with a cam (not shown, but conventional per se.) to move the rollers and thereby increase or decrease the length of travel of the material.

This printing and adjustment mechanism is only used when it is desired to print additional information on the material. Thus, as previously stated, the registration system can operate without this additional apparatus. The material then goes through a photo electric eye sensor means 28 which senses the location of the dot or other mark.

The sensor emits a light beam and when it hits the dot, it bounces back. Typically it can be set to read a "light" or "dark" image and thus it picks up contrast and in this way, senses the dot. Such a device is produced by SICK, a German company.

Figure 4:
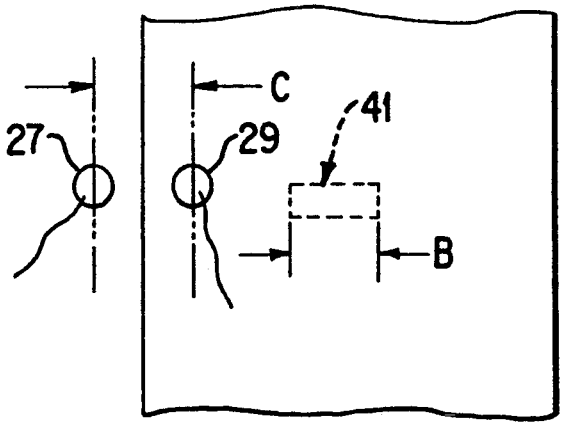
FIG. 4 is a schematic elevation of a portion of the apparatus shown in FIG. 3 when viewed in the direction of the arrow designated 4 in FIG. 3.

Two horizontal fiber optic sensors 27 and 29 are positioned (one behind the other as shown in FIG. 3) in this section; as also shown in FIG. 4. One (27) is positioned outside edge of the foil and the other (29) is positioned inside the edge of the foil. In a typical example, the dot or mark is 2 millimeters high by 5 millimeters wide as shown by dimension B in the FIG. 4. The sensors 27 and 29 would be positioned axially 4 millimeters apart as shown at C. As the foil moves longitudinally, it also drifts laterally. If the fiber optic sensor 27 (which is outside) is interfered with, then the machine gives an audible and visual signal to let the machine operator know that the machine has to be adjusted. The same is true if the foil drifts in the other direction to the point where the sensor 29 lies outside the material. Lateral adjustment is made back at the first feed roller by a manual device (which is well known in the art).

Referring again to FIG. 3 the material then passes over two additional guide rolls 30 and 32 and through a pre-heater designated generally 34.

Figure 5:
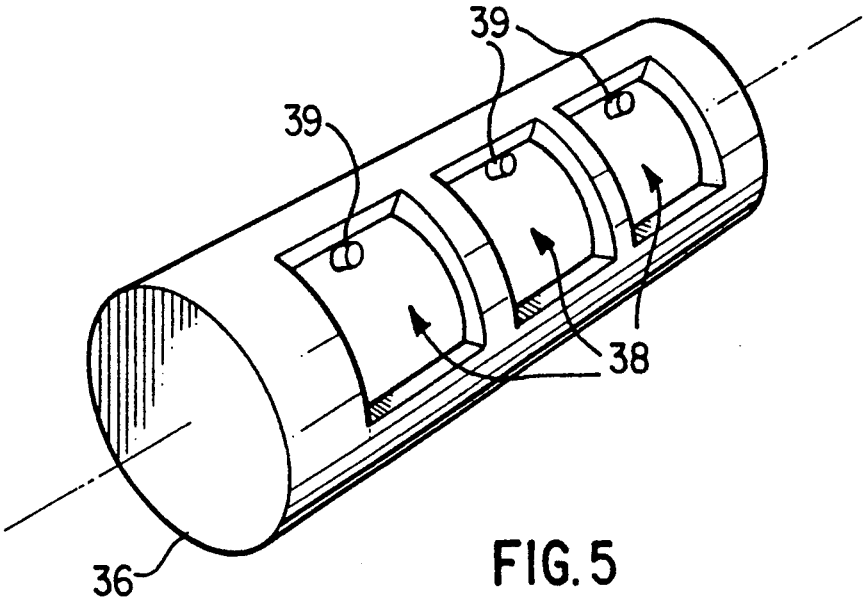
FIG. 5 is an enlarged perspective view of a portion of the apparatus shown in FIG. 3.

In the meantime, the plastic material which forms the bubble portion of the bubble package has been unwound from a second feed roll (not shown but conventional per se) and has been processed to be formed into its ultimate pre-formed shape. Thereafter, it passes around a drive roll 36 (shown in perspective in FIG. 5), the surface of which is scrolled, as at 38, FIG. 5, to control the movement of the plastic. The scroll has an indentation which is identical to the shape into which the plastic has been formed. The plastic then passes over a driven roller 40, FIG. 3. The pre-printed material 11 and the plastic material 35 are connected together in a heat sealer designated generally 42, FIG. 3, to form the finished package 37 in strip form.

Often the surface designated generally D, (shown in FIG. 3) of the material 11 has been pre-printed for example: with a multicolored presentation of information. The surface designated generally E of the plastic material 35 has been configured to assume a particular position with respect to this pre-printed material. For example, the plastic material may have a bubble indentation extending from the surface E outwardly from the normal planer web of the material (such as shown illustratively in FIG. 5 by the lines and arrows 39) which must be in registry with a colored circular area on the surface D and which, in the example of pharmaceuticals, may contain a pharmaceutical pill which has been placed into the bubble before it goes through the heat sealer 42. In such a situation, for proper visual presentation it's necessary for the bubble with its pill to be within the circle already pre-printed on the surface D. To accomplish this objective I control the stretching of the material 11 based on signals generated by devices monitoring the travel of the plastic packaging material and the travel of the pre-printed material. I will now describe this apparatus in greater detail.

The electric eye sensing means 28 sends a signal to a micro processor controller means (not shown, but typically available from a concern such as Allen Bradley). Sensor 28, as previously stated, is a "light" or "dark" sensor; that is, it senses either a light or dark presentation of data on a background. In this case it senses dark, since the dots which have been pre-printed on side A of the material 11 are normally black ink. They are rectangular in shape as shown by the dotted lines in FIG. 4 designated generally 41 to indicate that the black dot is placed on the side A which is the opposite side from that being viewed in FIG. 4. In summary, the sensor 28 sends the signal when it sees the black dot 41 and does not send a signal when that black dot is not in its path of vision.

The magnetic brake 17 FIG. 3 (not shown in great detail, but known in the art, such as produced by Mag-Power) controls the drag on the first feed roll 13. The amount of drag can be controlled in such a magnetic brake by the amount of voltage applied to it. The comparison of the signal from the electric eye 28 with another signal (to be described herein after) controls the amount of voltage supplied to the magnetic brake. This electrically operates the magnetic brake which applies a force to the first feed roll to correct the stretch of the material 11. The object of this force and correction is to register the front surface (D) printing of the pre-printed material 11 with the plastic cover material 35.

Figure 6:
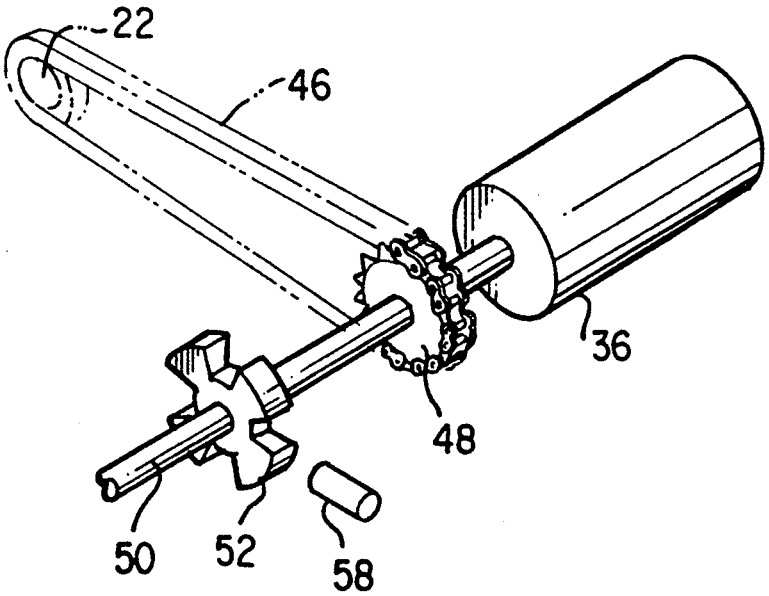
FIG. 6 is an enlarged perspective view partially exploded of a portion of the apparatus shown in FIG. 3 viewed from the rear.
Figure 7:
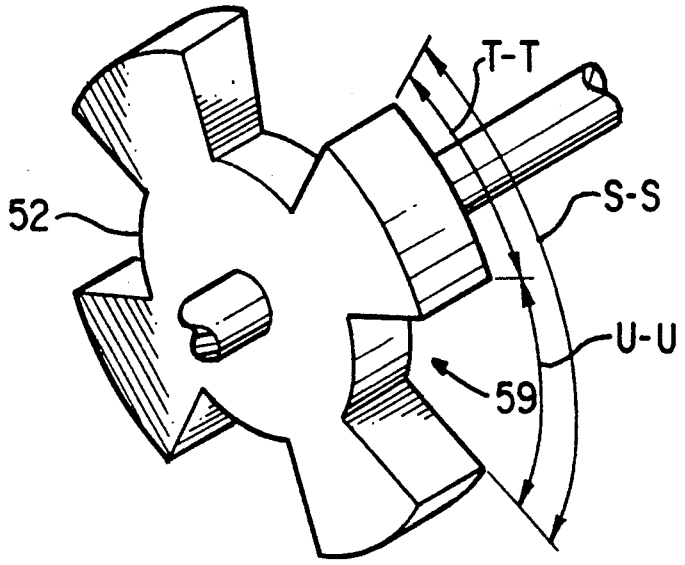
FIG. 7 is an enlarged perspective view partially broken away of a portion of the apparatus shown in FIG. 6.

Additional apparatus for controlling the tension is shown in greater detail in FIGS. 6, and 7.

The controls for the plastic material 35 are shown in FIG. 6. Note that 36 has a shaft 50 about which it rotates. A chain drive 46 is connected to a sprocket 48 mounted on a central shaft 50. This goes to the print roller 22. Also fixedly mounted to the shaft is a data cam or star wheel 52, shown in greater detail in the partial perspective view, FIG. 7. Therein it will be noted each pair of lobes and valleys on the star wheel match in circular segment a unit of plastic package being processed through the sealing rollers. The segment shown by the arcuate line and arrows S-S in FIG. 7 represents the amount of travel of the plastic material equal to the length of one plastic package, for example, 63 millimeters.

Thus, the S-S dimension equals in degrees the travel of one blister unit. The T-T dimension and the U-U dimension equal onehalf of the S-S dimension such that S-S equals T-T +U-U.

For example, if the sealing roller had 6 blister units around it, then the data cam or star wheel would have six lobes and six valleys, that is 360 degrees divided by 6 equals 60 degrees and the angle subsumed by the S-S dimension degrees where the angle subsumed by the T-T and U-U arcs would be 30 degrees each.

A sensing means 58, FIG. 6 is disposed in proximity to the star wheel 52 to sense the absence of metal. This sensing means is preferably set to sense a distance of no more than 2 millimeters. Thus when no metal is present, as is the case when the undercut portion or valley designated generally 59, FIG. 7 is passing by the sensor 58, the sensor is activated, that is, it is sending a signal. The signal may be, for example, 24 volts positive to the microprocessor controller.

Figure 8:
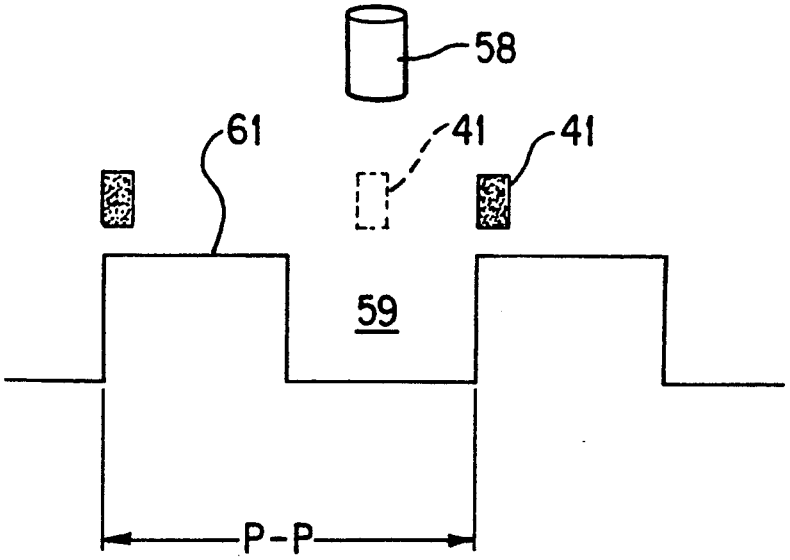
FIG. 8 is a graphic representation of a sensing functions of the apparatus shown in FIG. 3.

The manner in which the signal from the sensor 58 interacts with the signal from the sensor 28 in the microprocessor is best understood by first considering the schematic representation in FIG. 8. In this representation the lobes and valleys are shown stretched out in plan view such that the distance shown by the lines and arrows P-P is representative of the length of the package or the distance of travel S-S in FIG. 7. The sensor 58 senses the valley 59 which is half the length of the package as defined by the plastic pre-formed portion of the material 35. Simultaneously, the sensor 28 is sensing the black dots 41 printed on the reverse side A of the packaging material 11. Each is sending a signal to the controller continuously during that period when it is sensing. That is the sensor 58 does not send a signal when the lobe 61 is passing by it and the sensor 28 does not send a signal when the portion of the continuous pre-printed material 11 which does not include the black dots is passing in front of it. The materials are initially adjusted so that when they are running in registry the sensing signal from 58 will not be sent when the sensing signal from 28 is sent. This is because at that point 58 will be positioned over a lobe such as 61 and at that same point 28 will be positioned over a black spot such as 41; thus 58 will not send a signal, while 28 will send a signal.

Figure 1:
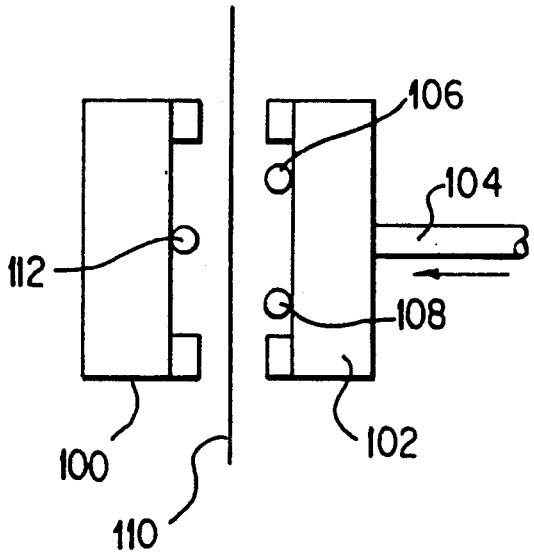
FIG. 1 PRIOR ART
FIG. 1 is a schematic view of a prior art device for stretching material.
Figure 2:
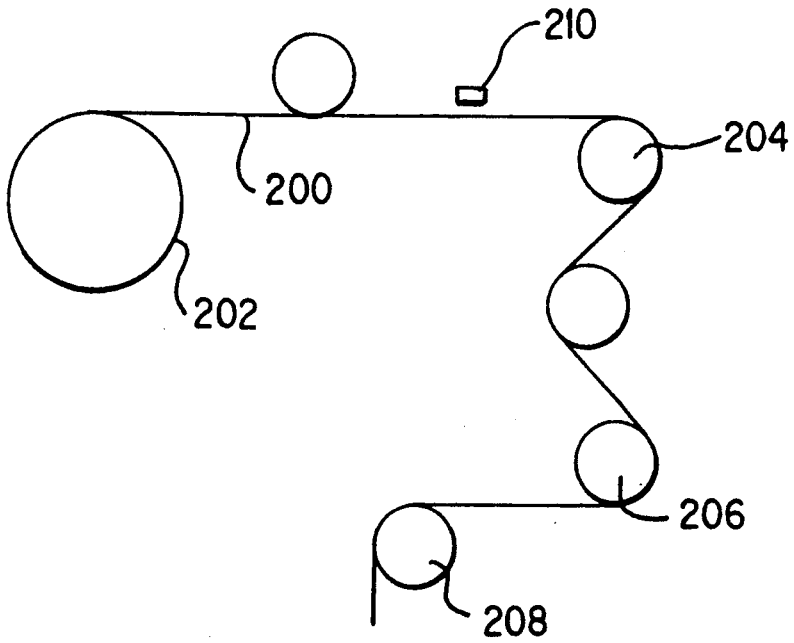
FIG. 2 PRIOR ART
FIG. 2 is a schematic view of another prior art device for stretching material.
Figure 9:
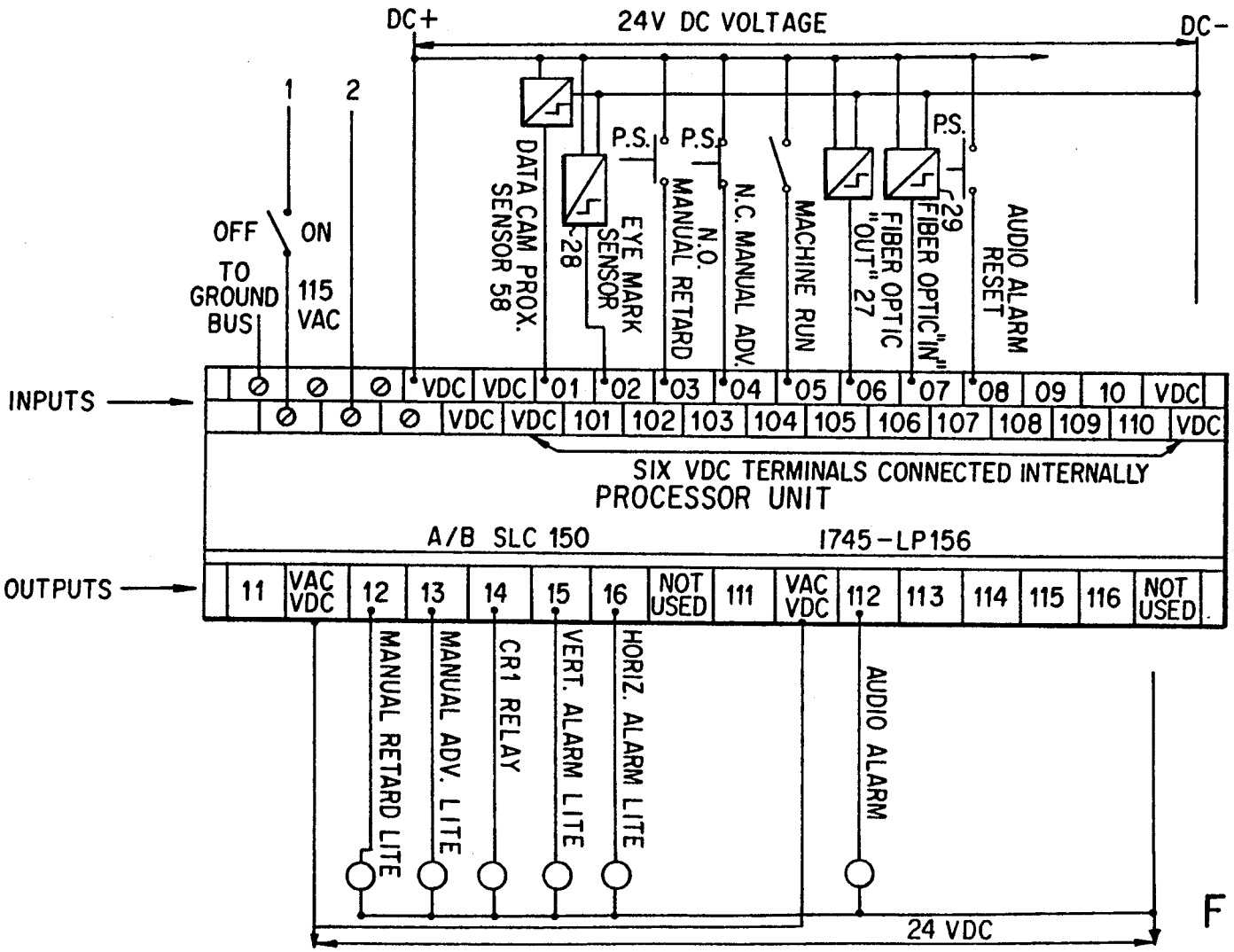
FIG. 9 is a graphic representation of the processor unit of the invention shown in FIG. 3.
Figure 10A:
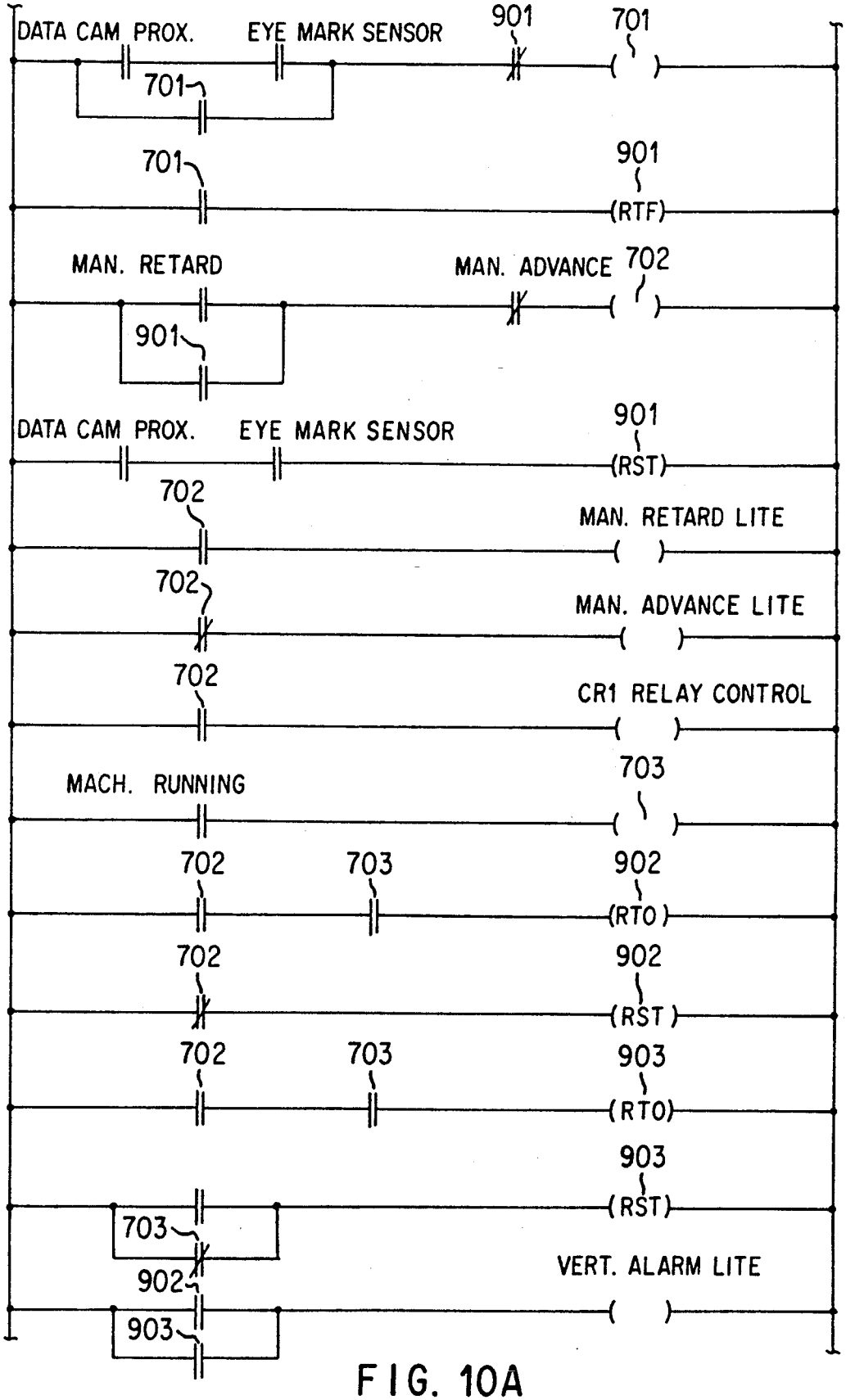
FIGS. 10A and 10B are electrical schematics of the processor shown in FIG. 9.

If during the course of operation of the machinery (as is the usual case) the material 11 creeps forward relative to the plastic material 35 then, in effect, the dot 41 will move to the position shown in dotted lines in FIG. 8 from the position shown in full lines. Since the sensor 28 senses the dot 41 it will then be sensing at the same time as the sensor 58 is sensing the valley 59. Each sensor, when it is in a sensing mode, is sending a signal back to the microprocessor as previously discussed. Typically this is 24 volts positive. Referring now to the schematic representation of the microprocessor circuitry relative to the functioning of the microprocessor in response to these signals as shown in FIG. 9, it will be noted that the sensor on the data cam or star wheel 52 gives its 24 volt positive input signal at the 01 input position. The sensor 28 for the eye mark or black dot 41 gives its 24 volt positive input signal at the 02 position. If the 01 and 02 positions get a signal at the same time, this energizes a relay 701 FIG. 10A which energizes a timer 902 FIG. 1A for a period of time, say for example, two seconds. This corresponds to two seconds of stretch. When the timer shuts off it opens the timer 901 shown as closed on the first line of FIG. 10A, thus returning the system to its initial condition.

As will be explained more fully hereinafter when the relay 701 is energized an increased voltage is applied to the magnetic brake thus increasing the drag and correspondingly increasingly the tension. When the timer 901 shuts off and returns the system to its original condition, this voltage is dropped back preferably by 20 percent; thus decreasing the tension. These values are set to draw the black dot back into the position shown in full lines and identified as 41 in FIG. 8 from the position shown in dotted lines in designated 41 in FIG. 8. In other words, I am pulling the material 11 back by stretching it and bringing the front face D of the material into register with the plastic surface E to which it must correspond. Since the material 11 is most preferably printed short in so far as the pre-printed black dots are concerned, this process repeats itself.

Figure 10B:
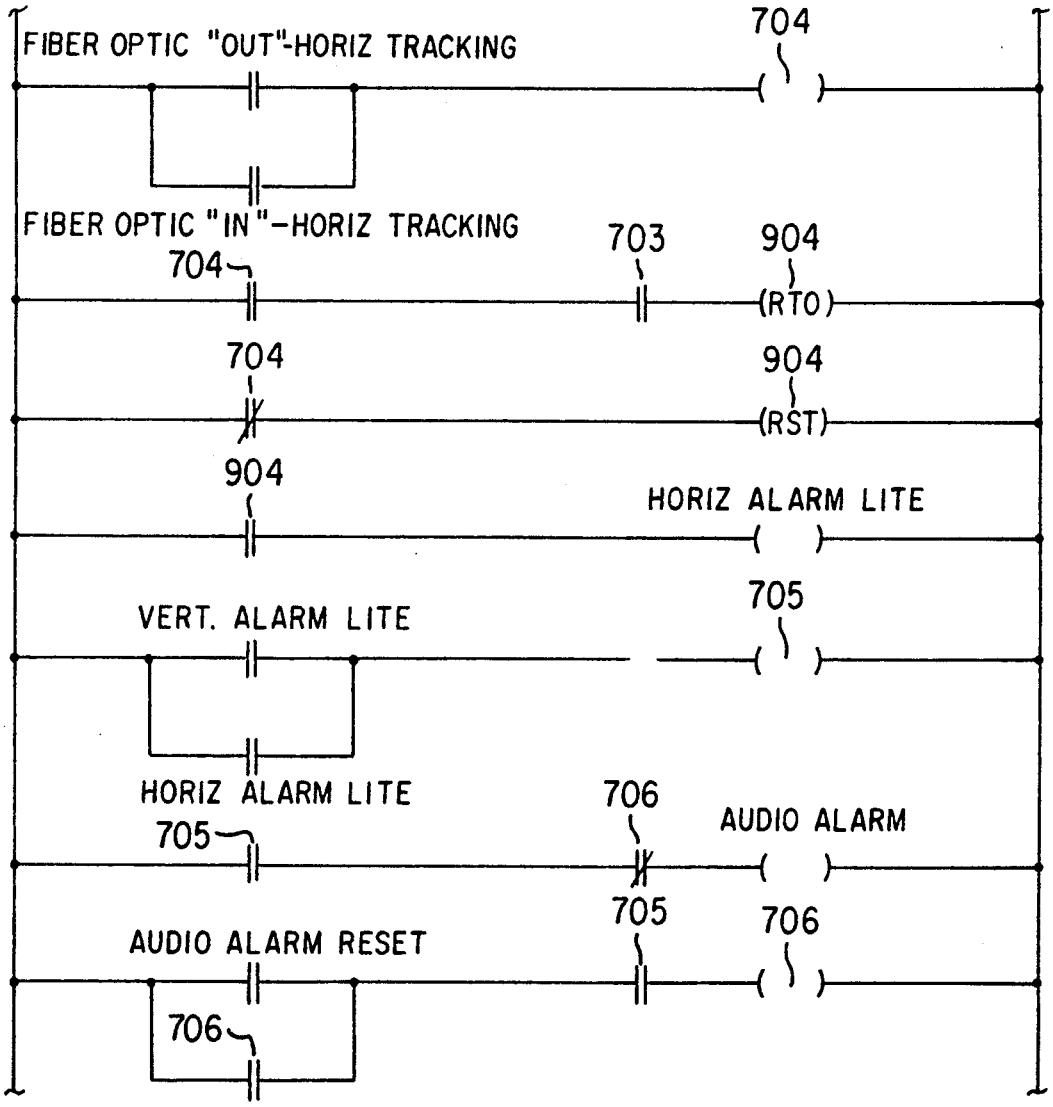
Figure 11:
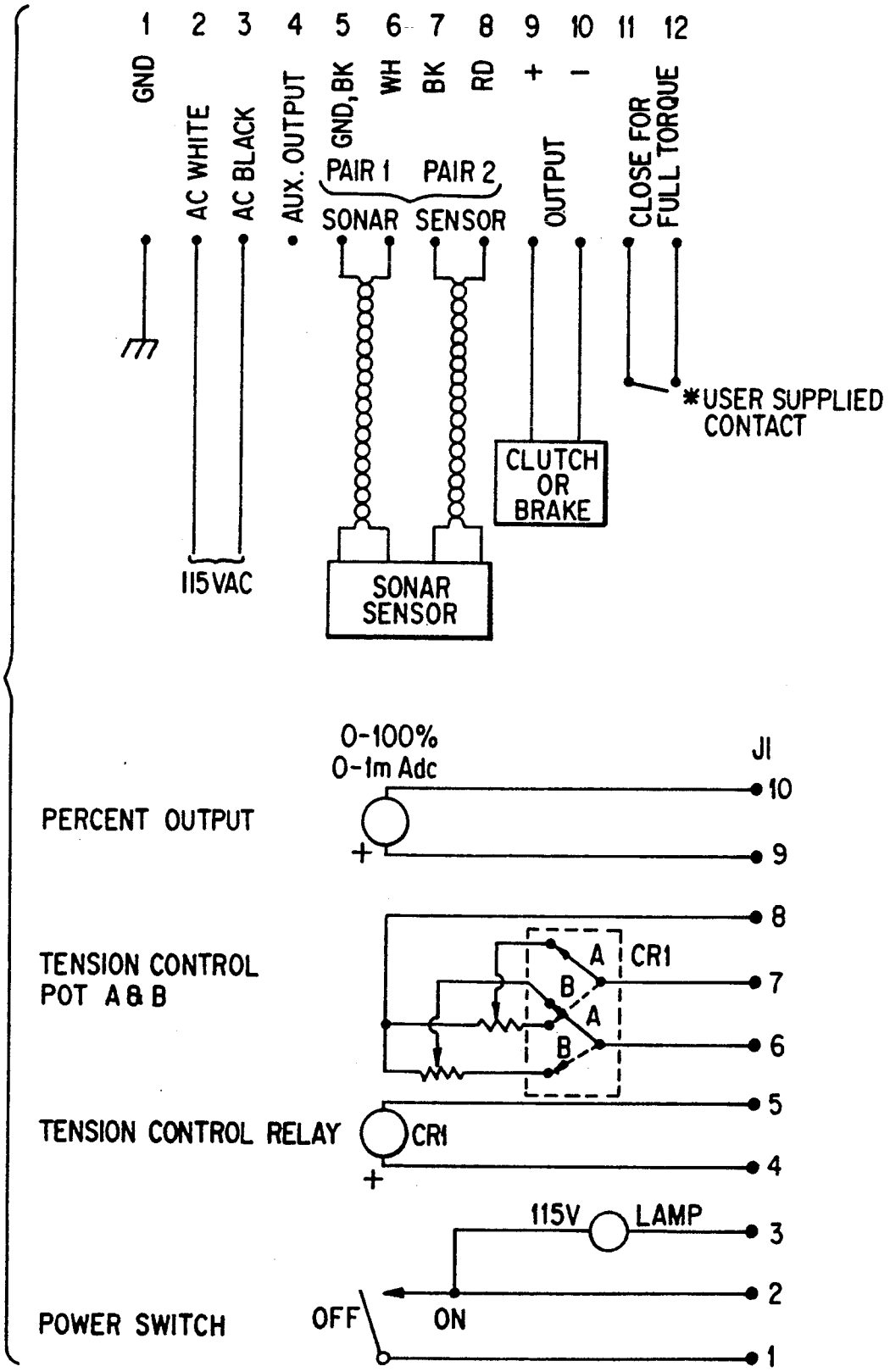
FIG. 11 is an electrical schematic showing the electrical connections of a portion of the apparatus shown in the prior figures in accordance with my invention.

The mechanism for changing voltage is shown in FIG. 11 wherein it will be noted that there is depicted schematically the tension control potentiometers A and B and the tension control relay CR1. The normal position for the tension controller potentiometers is that shown in the figure. This potentiometer setting is approximately 20 percent less than the potentiometer setting shown by the alternate position illustrated by dotted lines and arrows. This can be set manually. For example, if potentiometer A is set at 70, then potentiometer B would be set at 90. This ratio can be fixed by stacking the potentiometers so that a change of one automatically moves the other. Thus referring again to FIG. 10, when the two signals at 01 and 02 arrive simultaneously the circuit is closed, so that the relay 701 is activated, which in turn activates the time 901, which in turn activates the relay 702, which in turn closes the circuit and sends a signal to 14 which is the tension control relay coil CRI and this switches the tension control potentiometers from the A position to the B position as shown in FIG. 11 thereby sending an increased voltage signal to the magnetic brake 17, FIG. 3. When the timer runs its two second course, the relay, which is biased, returns the control relay contacts of CRI to its original position shown in full lines in FIG. 11 and the voltage is therefore dropped; which means less drag on the roll 10 and therefore reduced tension in the material 11. In these figures the 900 series are timers and the 700 series are relays.

Returning now to FIG. 4 and the fiber optic sensors 27 and 29 when considered in light of the schematic FIGS. 9 and 10 A & B note that the fiber optic sensor which lays outside the web of the material 11 designated 27 sends its signal to input position 06 and the fiber optic sensor which lies inside the view of the web of the passing portion of the material 11 designated 29 sends its signal to input position 7. The outside sensor 27 in its relaxed state is not giving any signal (since it is reflective) that is, it is set at "light" to operate. The inside sensor 29 is set to operate on "dark". If either closes, it picks up relay 704 as shown in FIG. 10B. It should be understood that relay 703 is closed while the machine is running. Timer 904 is set most preferably for 5 seconds. Thus if the alignment is out for more than 5 seconds then timer 704 times out and closes the circuit which gives an output on position 16 FIG. 9. If on the other hand, it gets back into alignment within the 5 seconds you would not get an alarm.

There is also a vertical alarm which gives an audible and visual indication. The audible can be reset, but the visual will stay lighted until vertical alignment is aligned. The vertical alarm is triggered by the tension control system not changing its tension mode in a preset amount of time. This may be set by the operator and is preferably 5 to 20 seconds; thus allowing it a breather period in which to get realigned.

It should be understood that a manual override is provided to manually retard the material 11 if it is being advanced. There is also a manual advance if you are in a stretched state which allows you to bring the material 11 back to a fixed state, all of which will apparent from studying figures.

As previously mentioned the pre-printed material is always printed short, that is if the package is 63 millimeters in length, then the dots are pre-printed at 62.9 millimeters or as close to that as can be had. If a softer material is used, then this dimension could be greater because it would be easier to stretch. Thus, since the material always "walks" forward, when it gets too far out of line (meaning, both sensors are sensing at the same time), the brake unit will stretch the material to bring into back to alignment. Thus this is a "one way" correction system, that is, it pulls in one direction to make correction. It is always stretch, followed by release, followed by misalignment, followed by stretch.

Another advantage of this invention is when it is used with the printer. In that regard it is noteworthy that such machines are bought with printers, but can't be used with pre-printed materials in precise registry. During the stretching process, one might expect to get poor quality printing and indeed without the stretching process waste factors could go as high as 40 percent. Since there is small incremental stretching in accordance with my invention, the materials can be run either as is or can have print added to the preprinted materials by the printing rollers in the machine.

OPERATION

In operation the apparatus for producing a package from two rolls of material, which are being continuously fed through it, provides a first feed roll of pre-printed first material and a means associated with it (known in the art) to continuously feed the material through the apparatus; a tension control means comprising a brake means to apply a resistive force to the feed roll of pre-printed material and stretch that material as it is being fed through the apparatus; a second feed roll for a second material to be combined in registry with the first material into the package and a means associated with the second feed roll (known in the art) to continuously feed the second material through the apparatus; a sensor for the first pre-printed material for sensing discrete segments of that material as it continuously moves through the apparatus and a sensor for the second material for sensing the position of discrete segments of that material as it passes through the apparatus and a controller means adapted to receive signals from both of said sensing means, said controller connected to a tension control means to regulate the resistive force applied by the brake means to the first feed roll to thereby increase or decrease the amount of stretch in said pre-printed first material.

This apparatus provides the method for forming packages by joining continuously moving materials. This method comprises providing a continuously moving first pre-printed material; applying a tension to said first pre-printed material; providing a second material continuously in registry with said first material; sensing discrete segments of said first material as it continuously moves through the apparatus; utilizing said sensing to determine a lack of registry of the continuously moving materials; and using said determination to apply an increased tension to said first material to bring said materials into registry with one another. Also, in accordance with this invention the operation of the apparatus provides a method wherein there is an additional step of returning the tension to its original state upon re-registering the materials.

Means are also provided in the apparatus for determining whether there have been lateral shifts in the pre-printed material and correcting those lateral shifts.

What I claim is:

1. In an apparatus for producing a package from two rolls of material being continuously fed therethrough, the improvements comprising:

A. a first feed roll of pre-printed first material and means associated therewith to feed said first material continuously through said apparatus;

B. tension control means comprising brake means to apply a resistive force to said feed roll of pre-printed material and stretch said material as it is being fed through said apparatus;

C. a second feed roll of a second material to be combined in registry with said first material into a package and means associated with said second feed roll and said second material to continuously feed said second material through said apparatus;

D. second material sensor means for sensing the position of discrete segments of said second material as said second material continuously passes through said apparatus, said second sensor means comprising a data cam in the form of a star wheel with lobes and valleys mounted on a shaft, said shaft being mounted in said apparatus; a scrolled cylinder mounted on said shaft; the scrolled portions of said cylinder engaging discrete segments of said second material; and wherein the segment of the star wheel comprising the lobe and one continuous valley corresponds to a discrete segment on said second material.

E. pre-printed first material sensor means for sensing the position of discrete segments of said first material as it continuously moves through said apparatus;

F. controller means adapted to receive signals from said second material sensing means and said pre-printed first material sensor means; and connected to said tension control means to regulate the resistive force applied by said brake means to said first feed roll to thereby increase or decrease the amount of stretch in said pre-printed first material.

2. The invention of claim 1 wherein: the brake means comprises a magnetic brake controlled by said controller means applying preset voltage potentials to said brake means.

3. The invention of claim 2 wherein said voltage potentials are preset such that one is twenty percent less than the other.

4. The invention of claim 1 wherein the second sensor means further comprises a depth perception sensor means juxtaposed to said star wheel so as to sense the presence of the valleys as the wheel rotates about the shaft and send a signal to the controller means.

5. The invention of claim 1 wherein the sensor means for sensing the pre-printed first material comprises an optical sensor and said pre-printed first material has a discrete image, pre-printed thereon and positioned so as to be read by said optical sensor as said first pre-printed material continuously travels through said apparatus; and said optical sensor sends a signal to said controller means.

6. The invention of claim 1, wherein said controller means reads the signals from said first and second sensor means and when it reads those signals simultaneously it applies a greater potential to the brake means to apply greater resistive force to the feed roll of the pre-printed material.

7. The invention of claim 6 wherein said controller means applies said greater resistive force for a fixed duration of time and then applies a lesser voltage substantially similar to the voltage applied before said controller means read said signal simultaneously.

8. The invention of claim 1 when sensor means are provided to sense the lateral movement of said pre-printed material as it moves continuously through said apparatus.

9. The invention of claim 8 wherein said lateral movement sensing means are a pair of optical sensors; one of said pair being positioned outside the normal line of travel of one edge of said pre-printed material and the other being positioned inside the line of travel of the same edge of said of pre-printed material.

10. The invention of claim 9 wherein said pre-printed material has printed thereon a dot for the purpose of being sensed by said pre-printed first material sensor, said dot having a lateral dimension slightly greater than the distance between the axes of the said optical sensors.

* * * * *